United States Patent [19]

Doyle et al.

[11] 4,251,017

[45] Feb. 17, 1981

[54] FASTENER DRIVING TOOL

[75] Inventors: Richard H. Doyle, Mt. Prospect; Bernard W. Geist, Melrose Park, both of Ill.

[73] Assignee: Duo-Fast Corporation, Franklin Park, Ill.

[21] Appl. No.: 29,160

[22] Filed: Apr. 11, 1979

[51] Int. Cl.[3] ..... B25C 1/04

[52] U.S. Cl. ..... 227/8; 227/113; 227/116; 227/136

[58] Field of Search ..... 227/1, 8, 107, 113–118, 227/136, 137

[56] References Cited

U.S. PATENT DOCUMENTS

| | | | |
|---|---|---|---|
| 1,539,894 | 6/1925 | Booth | 227/113 X |
| 2,605,466 | 8/1952 | Anderson | 227/113 |
| 3,261,526 | 7/1966 | Novak | 227/137 X |
| 3,298,584 | 1/1967 | Miller | 227/118 X |

FOREIGN PATENT DOCUMENTS

| | | | |
|---|---|---|---|
| 1550071 | 8/1979 | United Kingdom | 227/8 |

*Primary Examiner*—Paul A. Bell

*Attorney, Agent, or Firm*—Mason, Kolehmainen, Rathburn & Wyss

[57] ABSTRACT

A fastener driving tool includes a magnetized driver or a driver with an embedded permanent magnet that is of a tapered configuration. The tool also includes a fastener feeding mechanism that wedges or ejects a fastener from a fastener strip whereupon the fastener is attracted during free-flight to the driver by the magnet. The tool further includes a stop lever that prevents feeding of fasteners if the driver is in a position other than the full return position.

15 Claims, 10 Drawing Figures

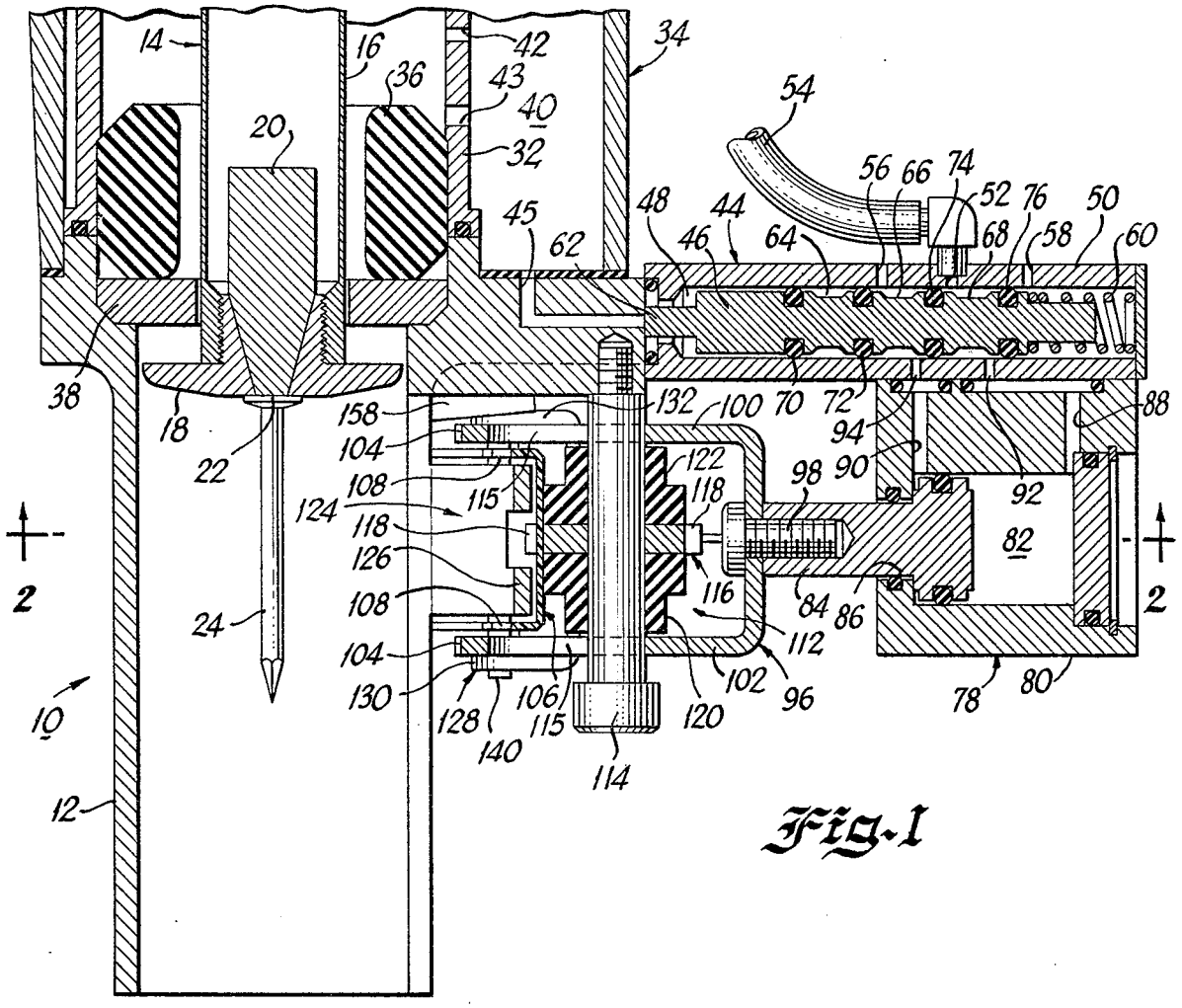
Fig. 1
Fig. 2
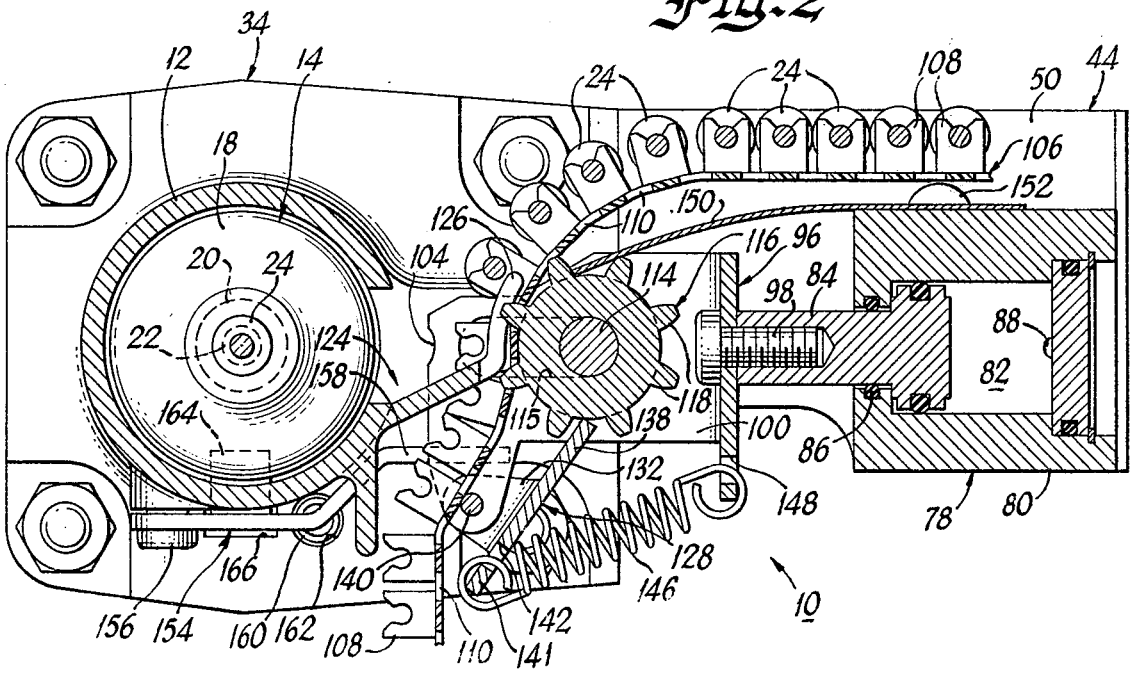

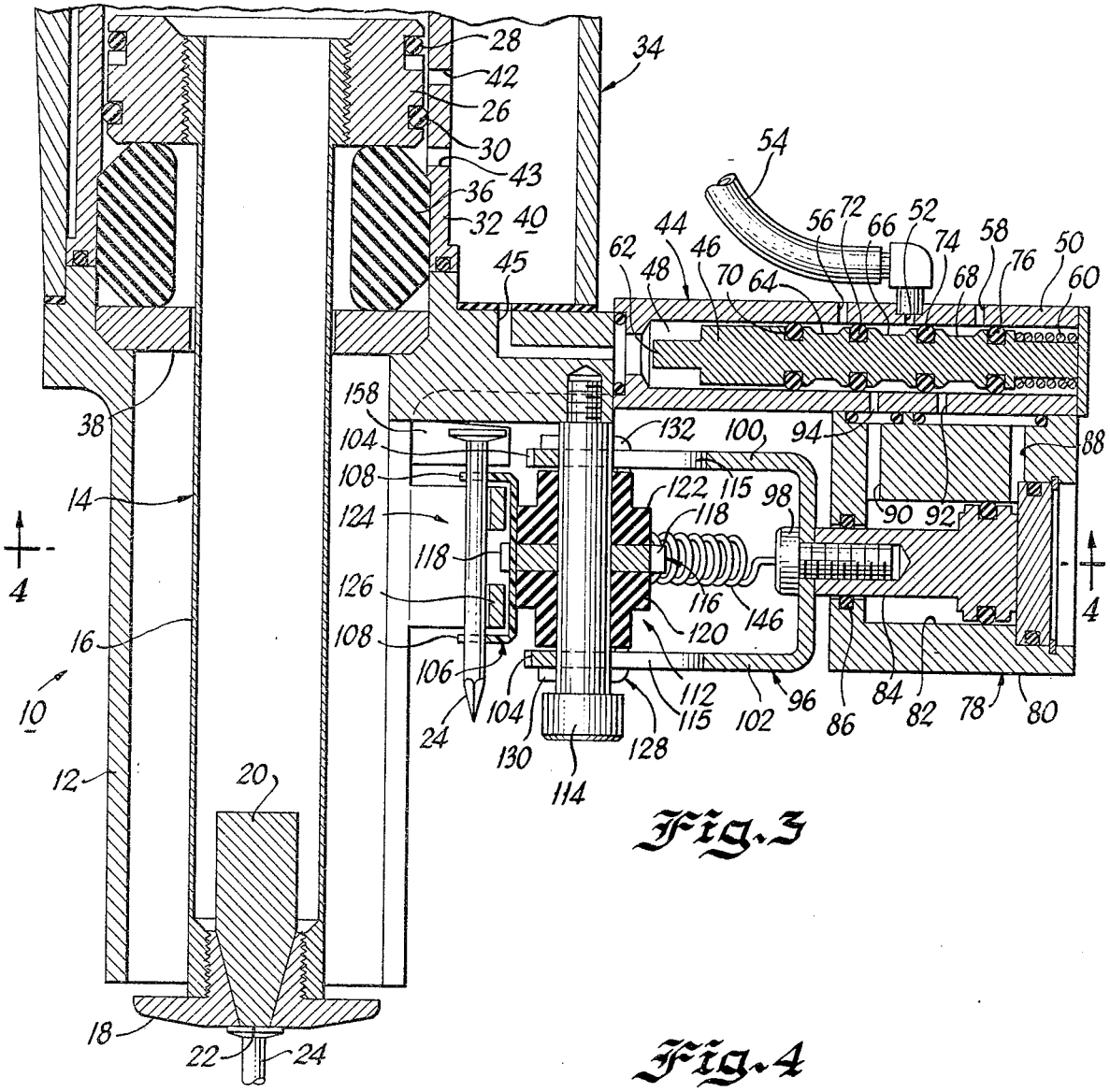
Fig. 3
Fig. 4
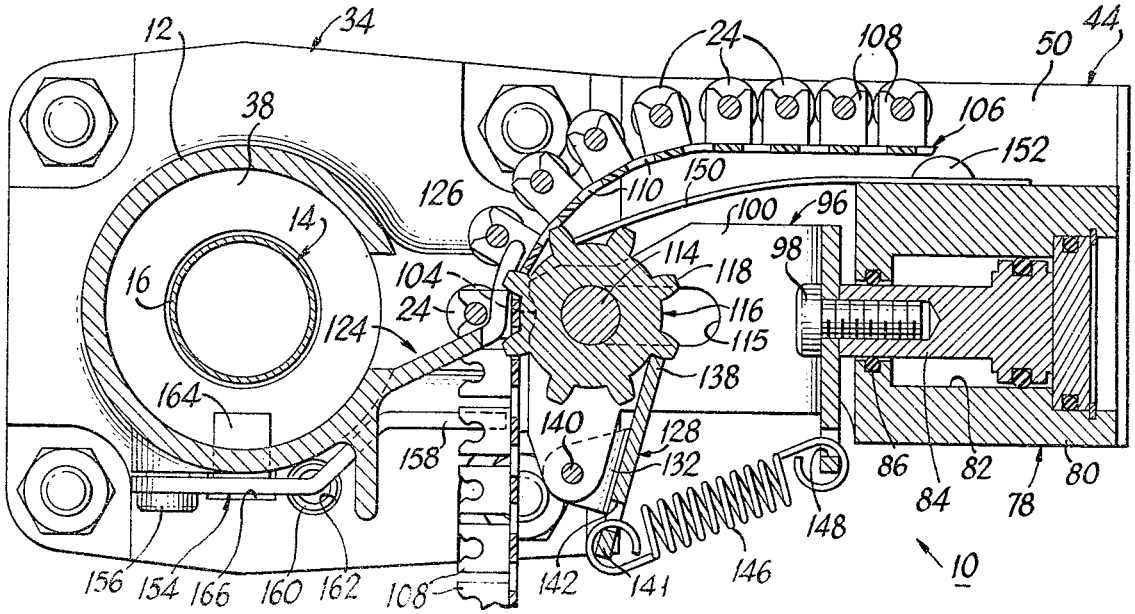

10
12
14
16
18
20
22
24
34
44
50
78
80
84
96
98
100
102
104
112
114
115
116
118
120
122
124
126
128
130
132
134
136
138
140
141
142
146
148
150
154
156
158
160
162
164
166

FASTENER DRIVING TOOL

BACKGROUND OF THE INVENTION

A. Field of the Invention

The device of the present invention relates to a new and improved tool for driving fasteners into a workpiece.

B. Description of the Prior Art

In driving fasteners into a workpiece such as wall board, plywood or similar material, a pneumatic or electrical tool is preferred. Such a tool may be of the basic KN type manufactured and sold by the Duo-Fast Corporation of Franklin Park, Ill.

Prior art tools typically include a housing defining a drive cylinder within which is reciprocally mounted a driver and employed to drive fasteners into the workpiece. The tools also include a feed mechanism for feeding fasteners to a location within the tool so that the driver may then drive the fastener.

Typically, fasteners are supplied in strips or coils and are secured by tabs or other means and the feed mechanism includes structure for detaching the fastener from the strip and placing it at the driving station of the tool. Prior art tools normally include a holding mechanism for maintaining the detached fastener in the driving position and the holding mechanism must be of a specific configuration to hold the fastener until it is engaged by the driver while at the same time avoiding contact with the driver that would result in destruction of the mechanism.

During operation of the typical prior art tool, a jam sometimes occurs and the driver remains in its down position after driving the fastener. In this jammed condition, it is preferred that another fastener not be fed into the drive track by the feeding mechanism for if feeding occurs, this will further jam the tool.

SUMMARY OF THE INVENTION

An object of the present invention is to provide a new and improved tool for driving fasteners into a workpiece.

Another object of the present invention is to provide a new and improved feed mechanism for a fastener driving tool that ejects fasteners from a fastener strip toward the driver of the tool.

A further object of the present invention is to provide a new and improved tool that includes a lever that prevents feeding of fasteners if the tool is jammed.

A further object of the present invention is to provide a new and improved fastener driving tool including a driver that is magnetized or includes a tapered magnet embedded therein.

Briefly, the present invention is directed to a new and improved fastener driving tool that in the preferred embodiment is pneumatic although other sources of energy may be employed. The tool of the present invention includes a housing defining a drive cylinder within which a driver for driving fasteners is reciprocally mounted. The driver is magnetized or includes a tapered magnet embedded therein for the purpose of holding fasteners onto the driver.

The tool further includes a feed mechanism including a fastener strip wherein fasteners are ejected from the strip toward the driver and are captured in free-flight and held onto the face of the driver by magnetic forces.

The feed mechanism also includes a stop lever that prevents feeding of fasteners if the tool is jammed.

BRIEF DESCRIPTION OF THE DRAWINGS

The above and other objects and advantages and novel features of the present invention will become apparent from the following detailed description of a preferred embodiment of the invention illustrated in the accompanying drawings wherein:

FIG. 1 is a side view of the tool of the present invention in the static or ready-to-fire position;

FIG. 2 is a view taken along line 2—2 of FIG. 1;

FIG. 3 is a view similar to FIG. 1 with the tool in the drive or return position;

FIG. 4 is a view taken along line 4—4 of FIG. 3;

FIG. 6 is a view taken along line 6—6 of FIG. 5;

FIG. 8 is a view taken along line 8—8 of FIG. 7;

DESCRIPTION OF THE PREFERRED EMBODIMENT

Figure 5:
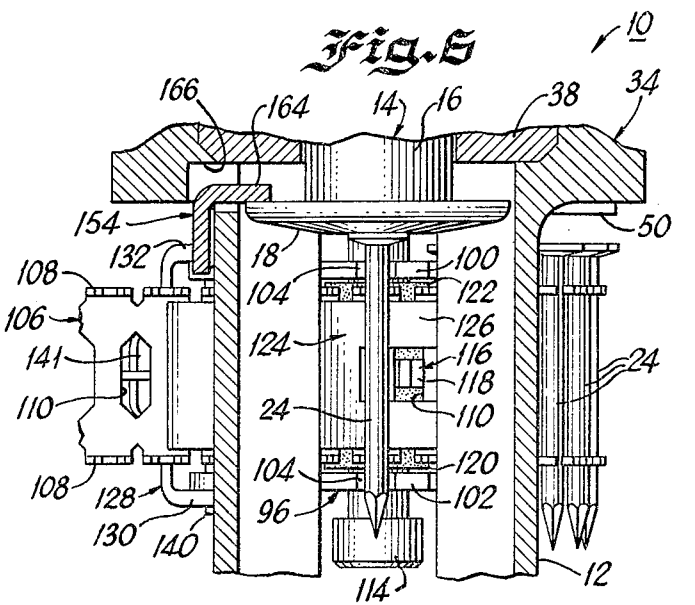
FIG. 5 is a side view of the tool of the present invention with the driver in the full return position and specifically illustrating the stop lever of the present invention.
Figure 5:
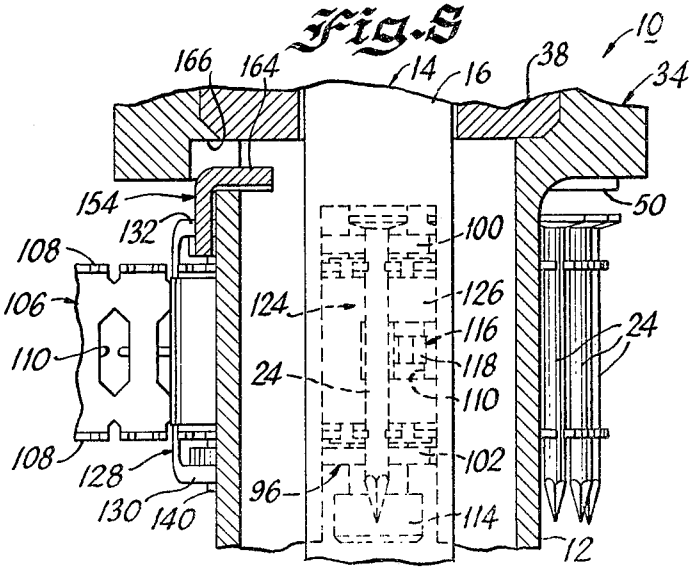
Figure 5:
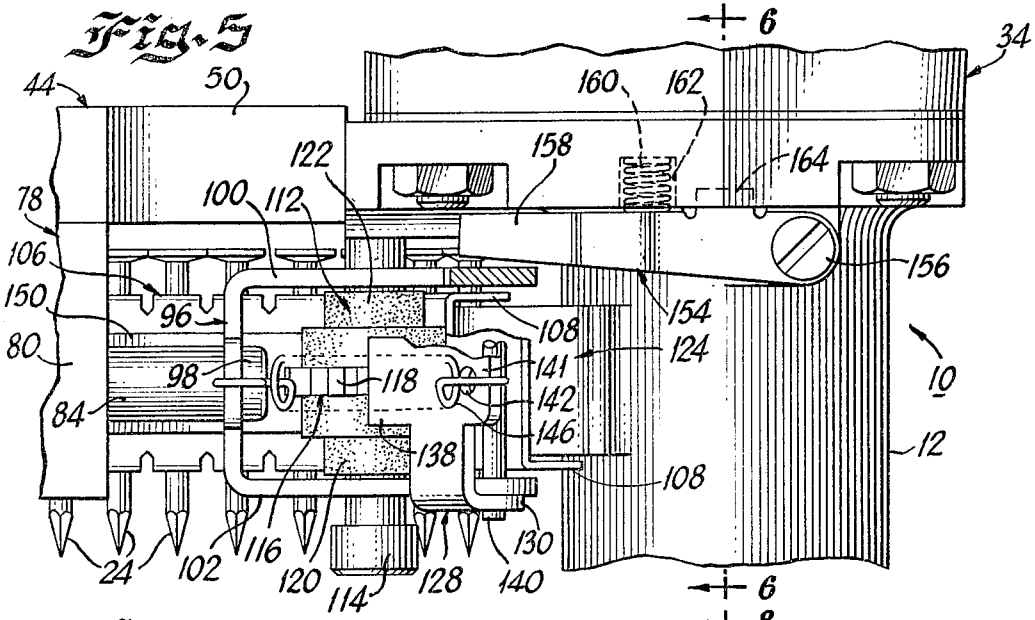
Figure 7:
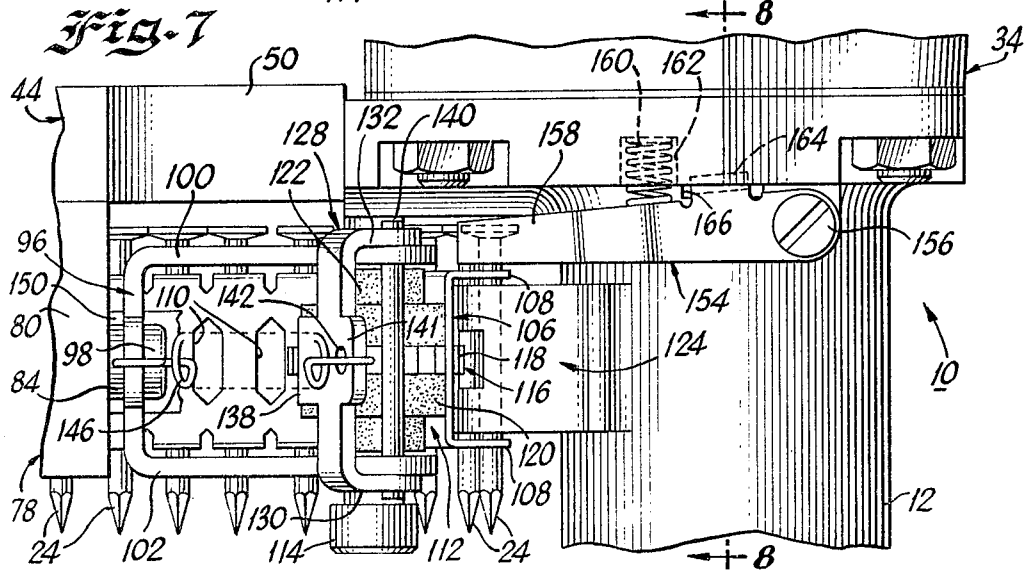
FIG. 7 is a view similar to FIG. 5 with the driver not being fully returned.

Having reference now to the drawings and initially to FIGS. 1 and 2, there is illustrated a portion of a basic tool employed for driving fasteners into a workpiece. In the preferred embodiment illustrated, the tool is of the pneumatic type and includes a front portion generally designated by the reference numeral 10 including a nose casing designated by the reference numeral 12. The nose casing 12 defines the track for the reciprocation of a driver generally designated by the reference numeral 14 employed to drive fasteners 24 into a workpiece. The driver 14 illustrated includes a tubular housing 16 and a driving head 18 secured at the lower end thereof as by threading or other means well known in the art.

In accordance with an important principle of the invention, the driving head 18 includes a permanent magnet 20 embedded therein. The magnet 20 is tapered with a small end 22 adjacent to the driving face of the driving head 18. With brief reference to FIG. 3, the upper end of the driver housing 16 includes a pneumatic piston 26 encircled by o-rings 28 and 30 that engage a drive cylinder 32 defined within the front portion 10 in the upper nose casing 34. The piston 26 interacts with pressurized fluid introduced within the drive cylinder 32 to fire or actuate the driver 16 in a downward direction in a driving stroke. At the completion of the driving stroke whereupon the fastener 24 is driven into the workpiece, the piston 26 engages a bumper 36 secured at the bottom of the drive cylinder 32 that serves to stop the downward motion of the piston 26 and prevents damage to the piston 26.

The tool illustrated is of the type employing a returned air reservoir 40 that is in fluid communication with the drive cylinder 32 through a passage 42 defined in the wall of the drive cylinder 32. As is well known in the art, as the piston 26 moves downward during the driving portion of the cycle of the driver, air compressed by the piston 26 within the drive cylinder 32 is forced through the passage 42 into the return reservoir 40. At the completion of the downward or driving stroke of the driver 14, the pressurized fluid above the piston 26 and within the drive cylinder 32 is vented to atmosphere and the pressurized fluid within the return reservoir 40 flows through passage 43 to the piston 26 to its static or ready-to-fire position as illustrated in FIG. 1.

The returned air reservoir 40 is also in fluid communication with a four-way or feed valve generally designated by the reference numeral 44 through a passage 45. The feed valve 44 includes a valve member 46 mounted within a bore 48 defined in a valve casing 50. The valve casing 50 is in fluid communication through a passage 52 with a conduit or tube 54 that is connected to a source of pressurized fluid. In addition, the valve casing 50 includes passages 56 and 58 that communicate the bore 48 with the atmosphere.

The valve element 46 is biased by a spring 60 to a position such that an extension 62 of the valve element 46 engages a portion of the tooling housing so as to seal the passage 45. Consequently, after the fluid in the return air reservoir 40 has returned the driver 14 to its static or ready-to-fire position, the pressure of the air or the fluid within the reservoir 40 is at or near atmospheric pressure which is of insufficient pressure to move the valve element 46 against the spring 60 to open the passage 45. This position of the tool with the reservoir 40 at or near atmospheric pressure is illustrated in FIG. 1.

The valve 46 includes a plurality of lands 64, 66 and 68 that are separated from each other by O-rings 70, 72, 74 and 76, thus defining separate chambers within the bore 48 separating the passages 52, 56 and 58 from each other. In the position illustrated in FIG. 1, the land 66 is in communication through the passage 56 with the atmosphere. This atmosphere pressure is communicated to a double acting cylinder or feed piston generally designated by the reference numeral 78. The feed piston 78 includes a piston housing 80 with a chamber 82 defined therein. Reciprocally mounted within the bore 82 is a piston 84 that extends through an aperture 86 in the housing 80. The housing 80 includes passages 88 and 90 that are in fluid communication with passages 92 and 94, respectively, defined in the valve casing 50.

In the static or ready-to-fire position of the tool illustrated in FIG. 1, atmospheric pressure is communicated through the passage 56, around the land 66 to the passages 94 and 90 to vent that portion of the chamber 82 in front of the piston 84. In addition, pressurized fluid from the tubing 54 is communicated through the passage 52 around the land 68 to passages 92 and 88 to communicate pressurized fluid to the chamber 82 behind the piston 84, thus fully extending the piston 84 through the aperture 86.

Figures 9, 10:
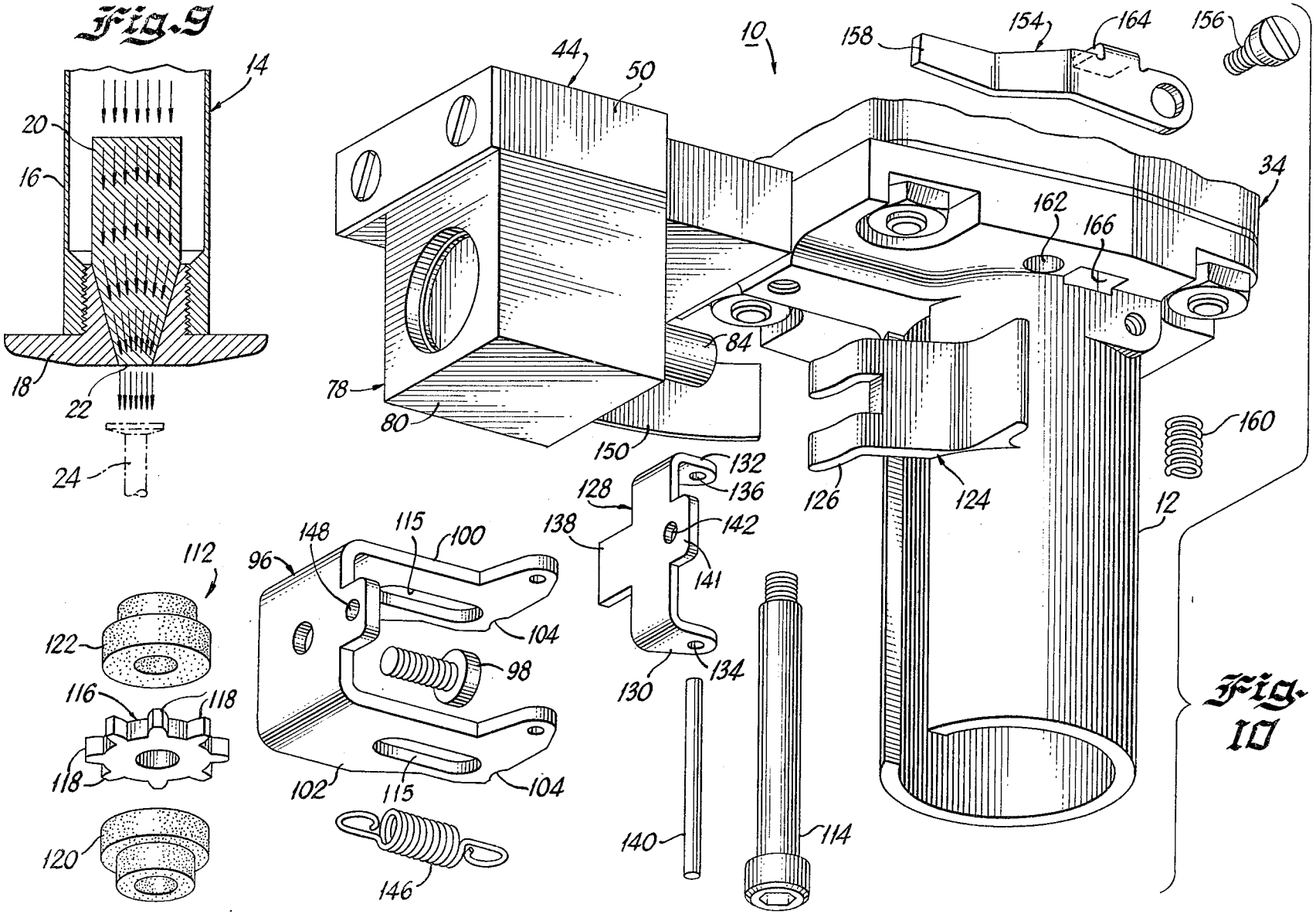
FIG. 9 is a cross-section view of the driver with an magnet embedded therein.
FIG. 10 is an exploded view of the feed mechanism of the tool of the present invention.

The piston 84 has connected thereto or includes an ejector member 96 coupled to the piston 84 by a screw 98 or similar fastener. The ejector 96 is of a U-shaped configuration including upper 100 and lower 102 legs in the form of plates with the leading edges of each including a rounded notch 104 that is intended to engage an individual fastener 24 (FIG. 10). The function of the ejector 96 is to engage a fastener 24 that is held onto a fastener strip 106 and eject or remove the fastener 24 from the strip 106 and propel the fastener 24 toward the driver 14 whereupon the fastener 24 enters the magnetic field of the permanent magnet 20 and is captured by the magnetic field and held in the position illustrated in FIG. 1.

With specific reference to the fastener strip 106 (FIGS. 2 and 4), the strip 106 includes tabs 108 that are notched within which the shafts of the fasteners 24 are positioned and held thereby. The fastener strip 106 further includes slots or openings 110 that allows feeding of the strip 106 to a position whereupon the ejector 96 may eject or remove a fastener 24.

The feeding of the strip 106 to allow the ejection of fasteners 24 is provided by a sprocket generally designated by the reference numeral 112 that is rotatably mounted on a shaft 114 extending through apertures 115 defined in the ejector 96 and secured to the housing of the tool. The sprocket 112 includes a sprocket wheel 116 with teeth 118 mounted between two bearing elements 120 and 122. The teeth 118 pass through the openings 110 in the fastener strip 106 and as the sprocket wheel 116 is rotated, the engagement of the teeth 118 with the openings 110 causes the fastener strip 106 to be advanced or fed so as to position fasteners 24 to be ejected by the ejector 96. The tool also includes a tape holder 124 that includes an arm 126 that is adjacent to the sprocket wheel 116 and tends to force the fastener strip 106 against the sprocket wheel 116 insuring proper engagement of the teeth 118 with the openings 110.

To advance the sprocket wheel 116, a feed pawl (FIG. 10) generally designated by the reference numeral 128 is included. The feed pawl 128 includes includes a U-shaped portion defined by legs 130 and 132 each including apertures 134 and 136 defined therein. Extending through these apertures 134 and 136 is a pin 140 that is secured to the legs 100 and 102 of the ejector 96 allowing pivotal movement of the feed pawl 128 relative to the ejector 96.

The feed pawl 128 further includes an extending arm 138 that engages the sprocket wheel 116. The arm 138 includes a rearward extension 141 with an aperture 142. A spring 146 is secured at one end in the aperture 142 and at another end through an aperture 148 defined on the ejector 96. As best illustrated in FIGS. 2 and 4, the spring 146 functions to bias the arm 138 of the feed pawl 128 against the sprocket 116 and in the static or ready-to-fire position illustrated in FIG. 2, the arm 138 is positioned between adjacent teeth 118.

To prevent backup of the tape 106, a backup pawl 150 is also included. The back up pawl 150 is resilient and secured by a rivet 152 or a similar fastener to the feed piston housing 80. The backup pawl 150 is of a curvilinear configuration including a second end that is positioned against the feed sprocket 116 between the teeth 118.

As can be best seen in FIGS. 2 and 4, the arm 138 of the feed pawl 128 is biased in a manner such that the teeth 118 can move in a counterclockwise direction without being inhibited by either the arm 138 of pawl 128 or the backup pawl 150; however, clockwise movement of the sprocket 116 is prevented by engagement of the anti-backup pawl 150 with one of the teeth 118.

Having described the basic structure of the tool, its operation will now be described. In the ready-to-fire or static position of the tool, the various structures described are in the positions illustrated in FIGS. 1 and 2. More specifically, a fastener 24 has been ejected from the strip 106 by the ejector 96 through the introduction of pressurized fluid from the tubing 54 into the passage 52 around the land 68 and through the passages 92 and 88 into the chamber 82.

To fire the tool, pressurized fluid is introduced into the raceway 32 above the piston 26 causing the piston 26 to move downwardly driving fastener 24 into a workpiece. At the completion of the driving or downward stroke of the driver 14, the piston 26 engages the bumper 36 at the position illustrated in FIG. 3. In this position, the compressed air in the return air reservoir 40 passes through the passage 43 to return the piston 26 to its static position or ready-fire position as illustrated in FIG. 1; however, simultaneously, this pressurized fluid in the return air reservoir 40 passes through the passage 45 to act against the extention 62 of the valve element 46. This pressure is sufficient to move the valve element 46 against the spring 60 and away from the opening of the passage 45 that is in communication with the bore 48. Thus the valve element 46 is moved to the position illustrated in FIG. 3.

In the position illustrated in FIG. 3, compressed air from the tube 54 is communicated through the passage 52 around the land 66 to the passages 94 and 90 to the chamber 82 in front of the piston 84. In addition, that portion of the chamber 82 behind the piston 84 is vented to atmosphere through the passages 88 and 92, across the land 68 and through the passage 58. Consequently, the piston 84 is retracted into the chamber 82 pulling with it the ejector 96.

As the ejector 96 is retracted, the feed pawl 128 is pivoted about the pin 140 by the spring 146. As this occurs, the arm 138 of the feed pawl 128 engages one of the teeth 118 rotating the sprocket wheel 116 about the pin 114, thereby advancing the feed strip 106 to move the empty tab 108 out of the feeding position and advance a fastener 24 into position to be ejected by the ejector 96.

Upon full return of the driver 14 to the position illustrated in FIG. 1, the return reservoir 40 is again at or substantially near atmospheric pressure. This reduction in pressure is communicated to the passage 45 such that the spring 60 returns the valve element 46 to the position illustrated in FIG. 1 wherein the extension 62 covers the passage 45.

Pressurized fluid is again introduced into the chamber 82 behind the piston 84 extending the piston 84 through the aperture 86 to the position illustrated in FIG. 1. The ejector 96 is then moved toward and into engagement with the fastener 24 ejecting or wedging the fastener 24 out of the slots in the tabs 108 and propelling the fastener 24 toward the driver head 18. The fastener 24 in free-flight enters the magnetic field of the magnet 20 and is captured by the magnet 20 and held against the tapered end 22 and the face of the driver head 18.

Positioning of the fastener 24 is essentially in the center of the driver head 18 since as illustrated in FIG. 9, the magnet 20 is tapered such that its small or tapered end 22 acts to concentrate the flux lines of the magnetic force developed by the magnet 20, increasing the flux density and causing the fastener 24 to be adjacent to the tapered end or small end 22 that is at the center of the driver head 18.

It is desired that ejection of a fastener 24 not occur if there is a jam in the tool such that the driver 14 is not fully returned to the static or ready-to-fire position. To avoid ejecting of a fastener during a jam, a stop lever 154 is included (FIGS. 5-8) which is pivotally mounted to the tool by a fastener 156.

The stop lever 154 includes an extension or arm 158 that in a first or down position (FIG. 7) is in alignment with the upper leg 100 of the ejector 96 such that the leading edge of the leg 100 will engage the arm 158 of the stop lever 154 preventing ejection of a fastener 24. Consequently, in the first or down position of the stop lever 154, a fastener 24 cannot be ejected. The stop lever 154 is maintained in the down position by a spring 160 that is mounted within a bore 162 defined in the tool housing.

The stop lever 154 further includes an L shaped flange 164 that extends through an opening 166 defined in the tool housing and into the nose casing 12 of the tool (FIGS. 6 & 8). The spring 160 biases the lever 154 downward in the first position to engage the flange 164 with the upper end of the nose casing 12 (FIG. 8) It is maintained in this position as long as the driver 14 is at the down position at the completion of the driving stroke (FIG. 3).

Upon full return of the driver 14 to the static or ready-to-fire position (FIG. 2), the driver head 18 will engage the tab or flange 164 and pivot the lever 154 upward about the fastener 156 (FIGS. 5 & 7) to a position wherein the arm 158 is moved out of alignment with the leg 100 of the ejection 96 to a second position. In this second position, the ejector 96 is free to move to the full extended position whereupon the fastener 24 is engaged and ejected from the fastener strip 106. Accordingly, the stop lever 154 functions to prevent ejection of a fastener 24 unless there is no jam and the driver 14 is allowed to return to its static or ready-to-fire position.

While the invention has been described with reference to details of the illustrated embodiment, it should be understood that such details are not intended to limit the scope of the invention as defined in the following claims.

What is claimed and desired to be secured by Letters Patent of the United States:

1. A tool of the type employed for driving fasteners includes a driver for driving fasteners into a workpiece and a feed mechanism for feeding said fasteners to be driven by said driver, said tool comprising a stop lever pivotally mounted on said tool including a first end aligned in a first position with said feed mechanism to prevent feeding of said fasteners, said lever including an abuttment member aligned with said driver and engageable thereby at the completion of a driving stroke to move said lever out of alignment with said feeding mechanism to allow feeding of a fastener.

2. The tool claimed in claim 1 wherein said driver is magnetized.

3. The tool claimed in claim 1 wherein said driver includes a magnet embedded therein.

4. The tool claimed in claim 3 wherein said magnet is tapered with the small end adjacent to the face of said driver.

5. In combination, a tool for driving fasteners into a workpiece including a housing defining a racetrack, a feeding mechanism for feeding fasteners to be driven, and a driver reciprocally mounted in said racetrack for driving said fasteners, said driver being magnetized such that said fasteners, once fed, are held on said driver by magnetic force, said driver includes a tapered magnet embedded therein with the small end of said magnet adjacent the driving face of said driver.

6. A method for feeding fasteners to be driven by a fastener driving tool wherein said fasteners are secured to a fastener strip and said tool includes means for driving said fasteners, said driving means being magnetized, means for advancing said strip to position a fastener adjacent said driving means, and means for removing said fasteners from said strip, said method comprising the steps of advancing said strip to position a fastener adjacent said driver, ejecting said fastener from said strip toward said driver, and capturing said fastener in free-flight in the magnetic field of said driver.

7. The method set forth in claim 6 further comprising the step of actuating said driver to drive said fastener into a workpiece.

8. A pneumatic tool for driving fasteners into a workpiece wherein said fasteners are carried on a strip, a feed mechanism for feeding fasteners to be driven by said tool, said feed mechanism including a feed sprocket mounted on said tool and engaging said fastener strip, a first feed pawl pivotally mounted on said tool and engaging said feed sprocket, a fastener ejector for ejecting said fasteners from said strip in free flight, a piston for actuating said ejector to eject said fasteners and for actuating said feed pawl to advance said sprocket, and a feed valve mounted on said tool in communication with a source of pressurized fluid, the atmosphere and said feed piston, said feed valve operable to actuate said piston.

9. The tool set forth in claim 8 wherein said feed mechanism further includes a second pawl engaging said sprocket for preventing backup of said sprocket.

10. The tool set forth in claim 8 wherein said piston is coupled to said feed pawl by a spring such that retraction of said piston pivots said feed pawl relative to said tool to advance said sprocket.

11. The tool set forth in claim 8 wherein said tool further comprises a driver for driving said fasteners into said workpiece and a reservoir for fluid for returning said driver to a static position after a driving stroke, said reservoir being in fluid communication with said feed valve whereby said fluid in said reservoir operates said feed valve to actuate said piston.

12. The tool set forth in claim 8 wherein said tool further includes a driver reciprocally mounted therein and said feed mechanism further includes a stop lever pivotally mounted on said housing with a first end aligned in a first position with said ejector to prevent ejection of a fastener, said stop lever including a flange engageable by said driver upon complete return of said driver after a driving stroke and moved to a second position wherein said first end is out of engaging position with said ejector thereby allowing ejection of a fastener.

13. The tool set forth in claim 8 wherein said tool further includes a magnetized driver.

14. The tool set forth in claim 8 wherein said tool includes a driver for driving said fasteners into said workpiece, and said driver includes a magnet embedded therein.

15. The tool set forth in claim 14 wherein said magnet is tapered with the small end thereof being adjacent the driving face of said driver.

* * * * *